US005725387A

United States Patent [19]

O'Sullivan et al.

[11] Patent Number: 5,725,387

[45] Date of Patent: Mar. 10, 1998

[54] SYSTEM FOR TERMINATING THE SHIELD OF A HIGH SPEED CABLE

[75] Inventors: Michael O'Sullivan, Willowbrook; David L. Brunker, Naperville; Gary S. Manchester, Naperville; Paul Murphy, Naperville, all of Ill.

[73] Assignee: Molex Incorporated, Lisle, Ill.

[21] Appl. No.: 609,577

[22] Filed: Mar. 1, 1996

[51] Int. Cl.[6] ..... H01R 4/66

[52] U.S. Cl. ..... 439/98; 439/610

[58] Field of Search ..... 439/98, 607, 92, 439/610, 885

[56] References Cited

U.S. PATENT DOCUMENTS

| | | | |
|---|---|---|---|
| 4,615,578 | 10/1986 | Stadler et al. | 339/143 |
| 4,813,888 | 3/1989 | Tokizane et al. | 429/583 |
| 4,921,447 | 5/1990 | Capp et al. | 439/585 |
| 4,960,392 | 10/1990 | Dickie | 439/620 |
| 5,025,554 | 6/1991 | Dohi | 29/860 |
| 5,061,827 | 10/1991 | Grabbe | 174/756 |
| 5,073,128 | 12/1991 | Sirai et al. | 439/585 |
| 5,083,929 | 1/1992 | Dalton | 439/98 |
| 5,114,366 | 5/1992 | Sato et al. | 439/585 |
| 5,120,241 | 6/1992 | Nakata et al. | 439/585 |
| 5,120,259 | 6/1992 | Nakata et al. | 439/585 |
| 5,145,409 | 9/1992 | Sato et al. | 439/585 |
| 5,180,316 | 1/1993 | Miller et al. | 439/610 |
| 5,197,893 | 3/1993 | Morlion et al. | 439/101 |
| 5,197,904 | 3/1993 | Gold | 439/581 |
| 5,222,898 | 6/1993 | Fedder et al. | 439/101 |
| 5,304,069 | 4/1994 | Brunker et al. | 439/108 |
| 5,315,063 | 5/1994 | Auclair | 439/98 |
| 5,415,568 | 5/1995 | Kinoshita | 439/98 |
| 5,495,075 | 2/1996 | Jonckheere et al. | 174/74 |
| 5,509,827 | 4/1996 | Huppenthal et al. | 439/638 |

FOREIGN PATENT DOCUMENTS

| | | |
|---|---|---|
| 0 670 676 A1 | 9/1995 | European Pat. Off. . |
| 0 694 989 A2 | 1/1996 | European Pat. Off. . |
| 0 385 020 B1 | 7/1996 | European Pat. Off. . |
| 2 718 299 A1 | 6/1995 | France . |

*Primary Examiner*—Khiem Nguyen
*Assistant Examiner*—Eugene G. Byrd
*Attorney, Agent, or Firm*—Charles S. Cohen

[57] ABSTRACT

A method is disclosed for terminating the metallic shield of a high speed cable which includes an inner dielectric inside the metallic shield, as well as a system for effecting the method. At least a portion of the outer jacket of the cable is removed to expose a portion of the metallic shield. An insulating member is positioned between the metallic shield and the inner dielectric of the cable. The cable then is positioned on a conductive terminating member having a portion in registry with the exposed portion of the metallic shield outside the insulating member. The metallic shield is soldered to the portion of the terminating member, as the insulating member protects the inner dielectric from the heat of the soldering step.

25 Claims, 4 Drawing Sheets

SYSTEM FOR TERMINATING THE SHIELD OF A HIGH SPEED CABLE

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible (i.e., a region bounded by the conductor/core and by the braid) and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved method of terminating the metallic shield of a high speed cable, as well as a system for terminating the shield of the cable.

In the exemplary embodiment of the invention, the method includes providing the high speed cable with an exposed portion of the metallic shield. A thermally insulating sleeve is positioned between the metallic shield and the inner dielectric of the high speed cable. A conductive terminating member is provided with a gripping arm. The cable is positioned on the terminating member. The gripping arm is formed into gripping engagement with the exposed portion of the metallic shield outside the insulating sleeve. The metallic shield then is soldered to the gripping arm as the insulating sleeve protects the inner dielectric from the heat of the soldering.

Preferably, the gripping arm is formed with an opening therethrough for registering with the exposed portion of the metallic shield. The soldering step is carried out by soldering through the opening. In the exemplary embodiment, the gripping arm is formed about a substantial portion of the high speed cable, and the opening is formed as a circumferentially extending slot.

The conductive terminating member is disclosed herein as a ground plate having a blade portion with an opposed pair of the gripping arms at opposite edges of the blade portion for gripping a pair of high speed cables therebetween, with both cables including the insulating sleeves. In the preferred embodiment, a pair of the opposed gripping arms are formed on each opposite side of the blade portion of the ground plate. The insulating sleeves are fabricated of a thermally insulating material such as high temperature plastic.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
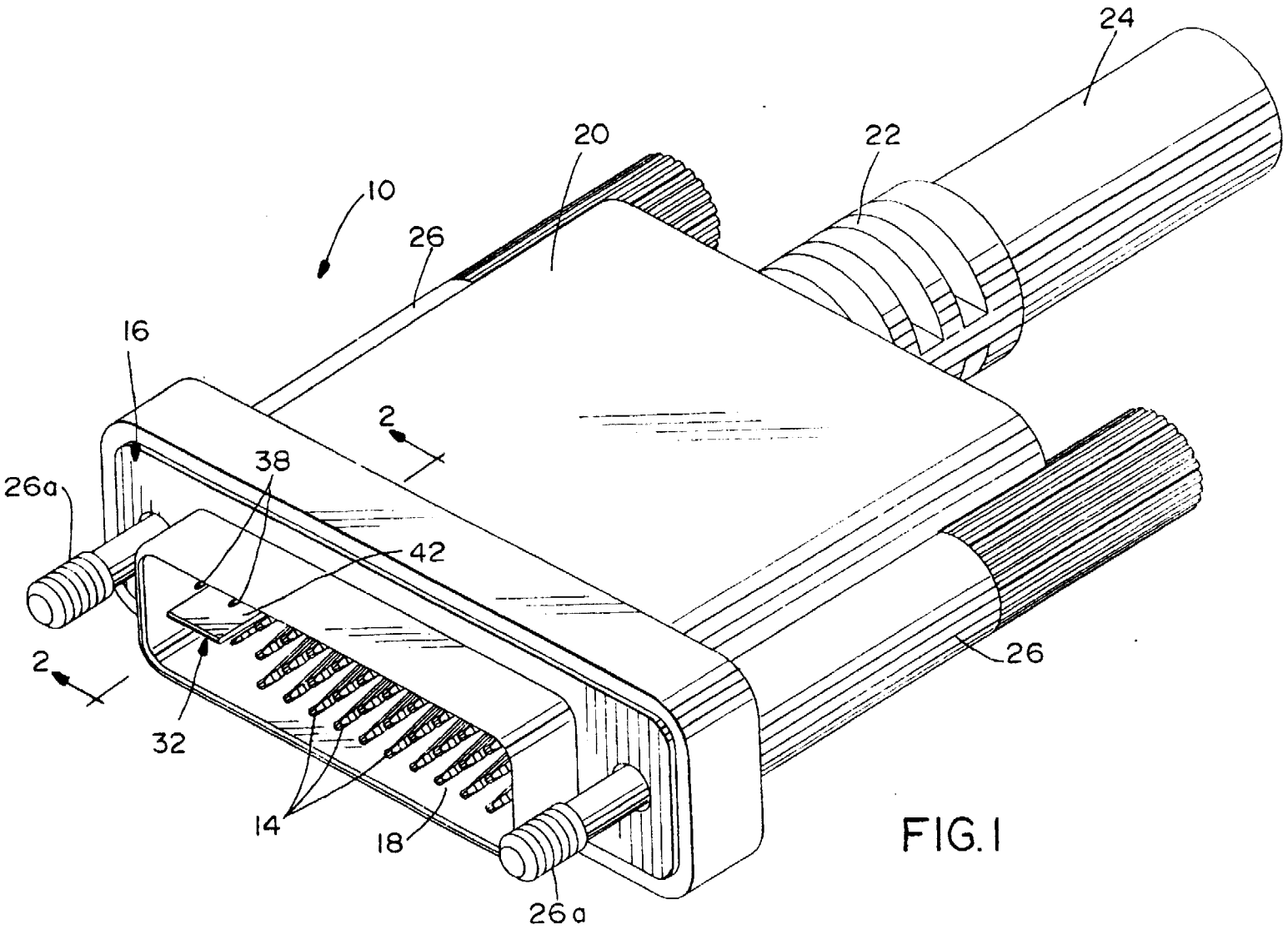
FIG. 1 is a perspective view of an electrical connector of a type in which the invention is applicable.
Figure 2:
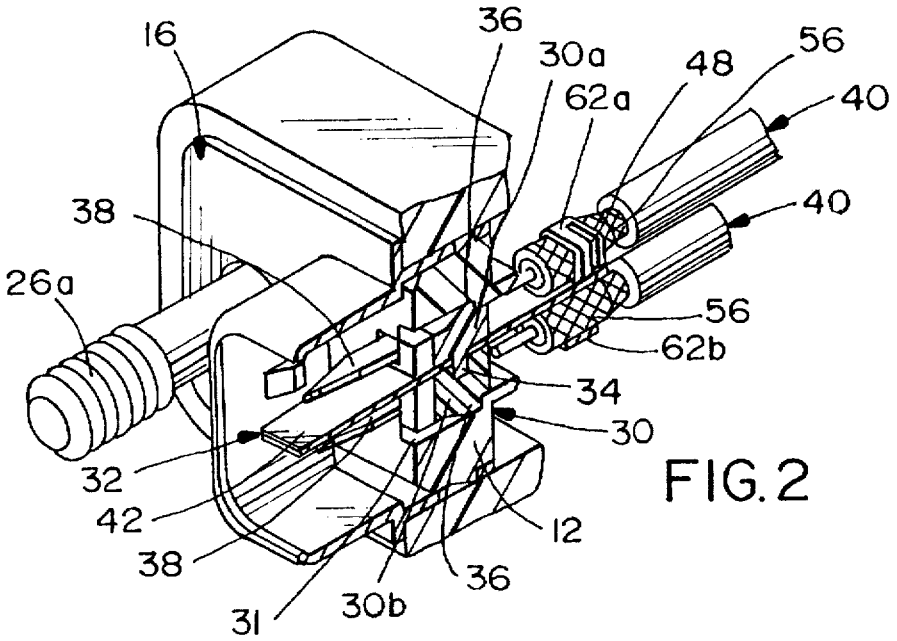
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends **26*a*** for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of terminal blocks **30*a* and 30*b* which clamp a ground plate, generally designated 32, therebetween. Each terminal block includes a post 34 and a recess. The post from each terminal block extends from each terminal block through a hole or slot 44 (FIG. 5) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by a pair of ramped latches 36** on each terminal block.

Each terminal block **30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 9) are terminated to the center conductor/cores 52 of a plurality of coaxial cables, generally designated 40 in FIG. 2. The invention is particularly directed to the manner of termination of the metallic shields 56 of the coaxial cables to ground plate 32**, as described below.

Figure 5:
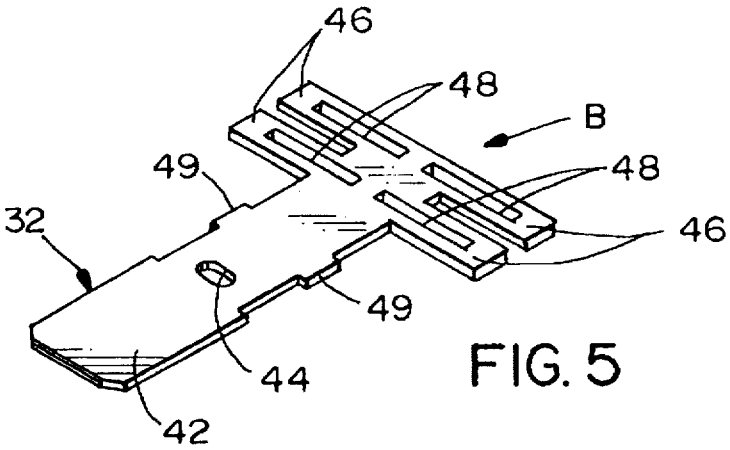
FIG. 5 is a perspective view of a stamped metal blank from which the terminating member or ground plate is formed.

More particularly, FIG. 5 shows a blank, generally designated "B," stamped from conductive sheet metal material and from which ground plate 32 is formed. Blank "B" is generally T-shaped and includes a leg or stem portion 42 which will form a blade portion for ground plate 32. The blade portion includes an aperture 44 through which posts 34 (FIG. 2) of terminal blocks **30*a* and 30*b* extend. A pair of wings or arms 46 project outwardly at one end of leg 42 generally at each opposite edge thereof. These wings will form the gripping arms of the ground plate, as will be seen hereinafter. Each wing or gripping arm has an elongated slot 48** to facilitate the solder termination described hereinafter.

When soldering the cable shield 56 to ground plate 32, it is desirable to use a soldering iron having a relatively small tip. Although it is desirable to dimension the slot wide enough to facilitate adequate solder flow throughout the slot, it should be narrow enough to prevent the relatively small tip of the soldering iron from contacting the braid or shield 56 of the cable, which could result in damage to the underlying insulation 54. Each slot is on the order of approximately 0.040 inch wide, although it is believed that such slot could be within the range of 0.110 to 0.010 inch wide. Finally, barbs or teeth 49 are stamped at the opposite edges of blade portion 42 to facilitate holding the subassembly of the ground plate and terminal blocks **30*a* and 30*b*** within the housing.

Figure 3:
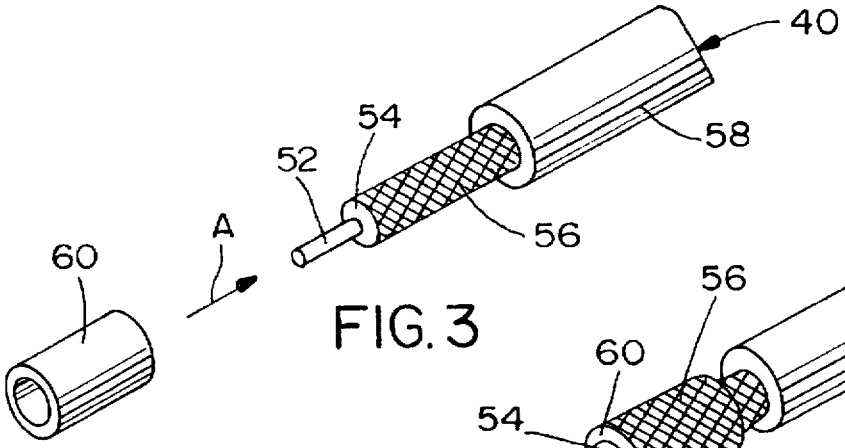
FIG. 3 is a perspective view of one of the coaxial cables prepared for use with the invention, in conjunction with one of the insulating sleeves.
Figure 4:
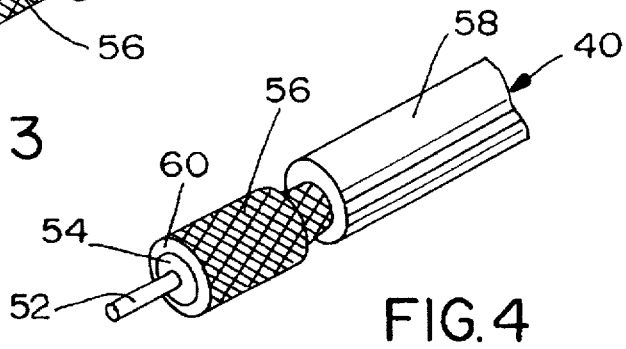
FIG. 4 is a perspective view of the coaxial cable prepared as shown in FIG. 3, with the insulating sleeve inserted between the metallic shield and the dielectric of the cable.

Either before or after or simultaneously with stamping blank "B" from sheet metal material, one or more coaxial cables 40 are prepared as shown in FIGS. 3 and 4. At this point, it should be understood that each coaxial cable 40 is of a conventional construction in that each cable includes a center conductor or core 52 surrounded by a tube-like inner dielectric 54. A metallic shield in the form of a tubular metallic braid 56 surrounds inner dielectric 54. An insulating jacket 58, as of plastic or the like, surrounds metallic braid 56 to form the overall composite coaxial cable 40.

Figure 9:
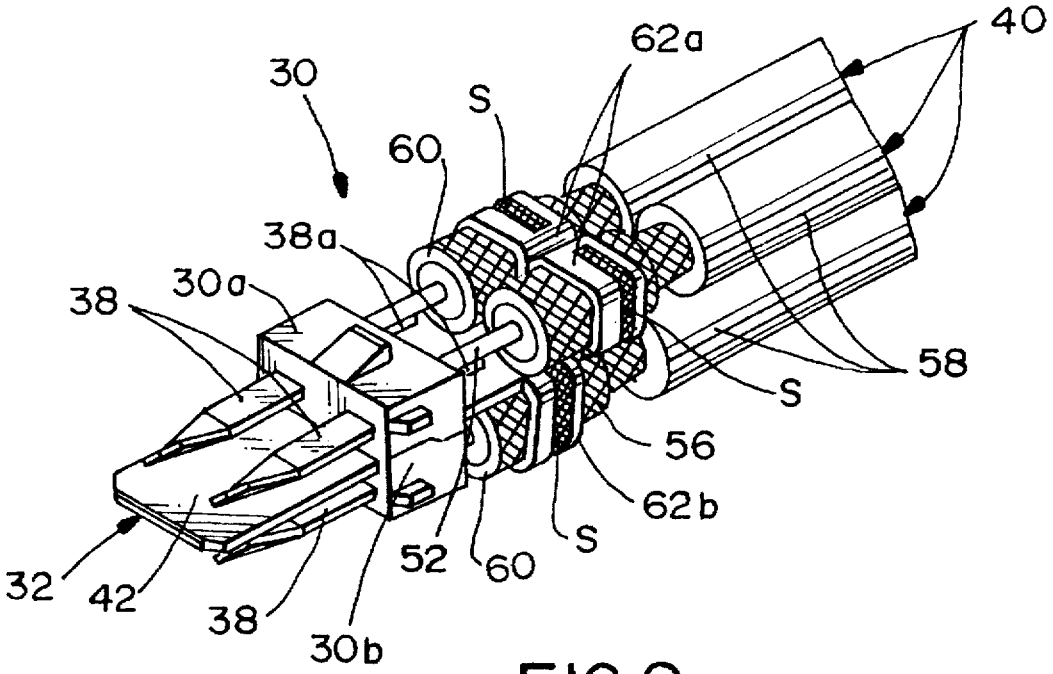
FIG. 9 is a perspective view of the subassembly of FIG. 8 assembled into the terminal module shown in FIG. 2.

FIG. 3 shows that center conductor/core 52 of coaxial cable 40 has been stripped to expose a given length thereof which is soldered to the inner end 38*a* of one of the high speed signal transmission terminals 38 (FIG. 9). The outer insulating jacket 58 of the cable also has been cutback to expose a given length of the metallic shield 56. Therefore, the exposed shield can be soldered to ground plate 32 as described hereinafter.

FIG. 3 shows the prepared coaxial cable in conjunction with an insulating tubular sleeve 60 which has an inside diameter to fit over inner dielectric 54 of the coaxial cable. The insulating sleeve is positioned over the inner dielectric in the direction of arrow "A" (FIG. 3) and beneath the metallic braid 56 to a position shown in FIG. 4 wherein the front end of the sleeve is generally flush with the front end of the dielectric. In other words, the insulating sleeve is sandwiched between the metallic shield and the dielectric. The sleeve is fabricated of a thermally insulting material such as high temperature plastic or a ceramic material that is sufficiently resistent to heat so that the metallic braid or shield can be soldered, while the sleeve protects inner dielectric 54 from the heat of the soldering process.

Figure 6:
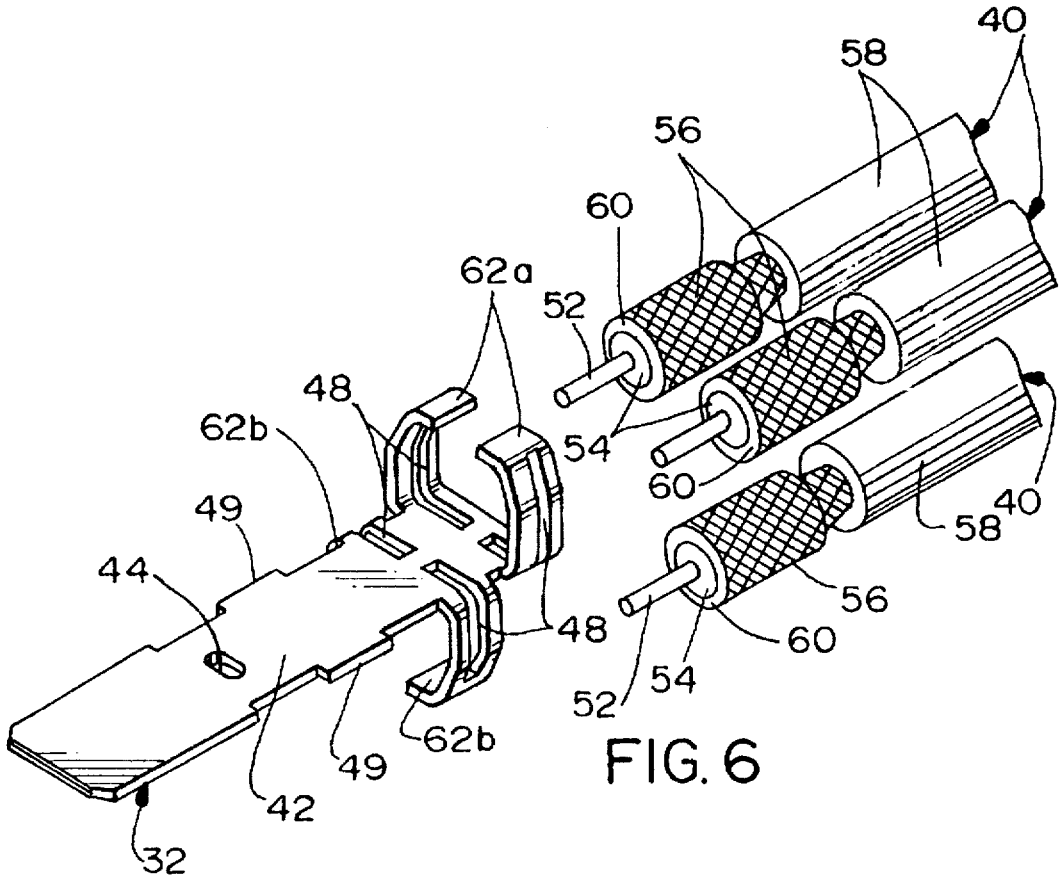
FIG. 6 is a perspective view of the ground plate, with the gripping arms formed to their preliminary or open positions, and in conjunction with a plurality of coaxial cables having the insulating sleeves inserted therein.

FIG. 6 shows the stamped blank "B" of FIG. 5 with wings 46 having been bent inwardly to form a pair of upper gripping arms 62*a* and a pair of lower gripping arms 62*b*. It can be seen that, after forming, slots 48 in the gripping arms extend in a circumferential direction and into blade portion 42 of ground plate 32. Preferably, the slots extend from a point near the distal ends of the gripping arms to a point near the center of blade portion 42. In essence, the ground plate is provided with a pair of opposed gripping arms at opposite edges of the plate for gripping a pair of coaxial cables, as well as providing a pair of opposed gripping arms on each opposite side of the plate. One pair 60*a* is located at the extreme rear distal end of blade portion 42, and the other pair 62*b* is located slightly spaced longitudinally forward of the first pair. With this structure, the ground plate can terminate from one to four coaxial cables depending on the specifications of the connector. In some computer applications, three cables may be used to carry the red, green and blue chroma signals for a monitor. A fourth cable might be used for flat screen monitors for carrying the pixel clock timing signals. Three coaxial cables 40, having been prepared and with insulating sleeves 60 inserted thereinto, are shown in FIG. 6 about to be positioned onto ground plate 32.

Figure 7:
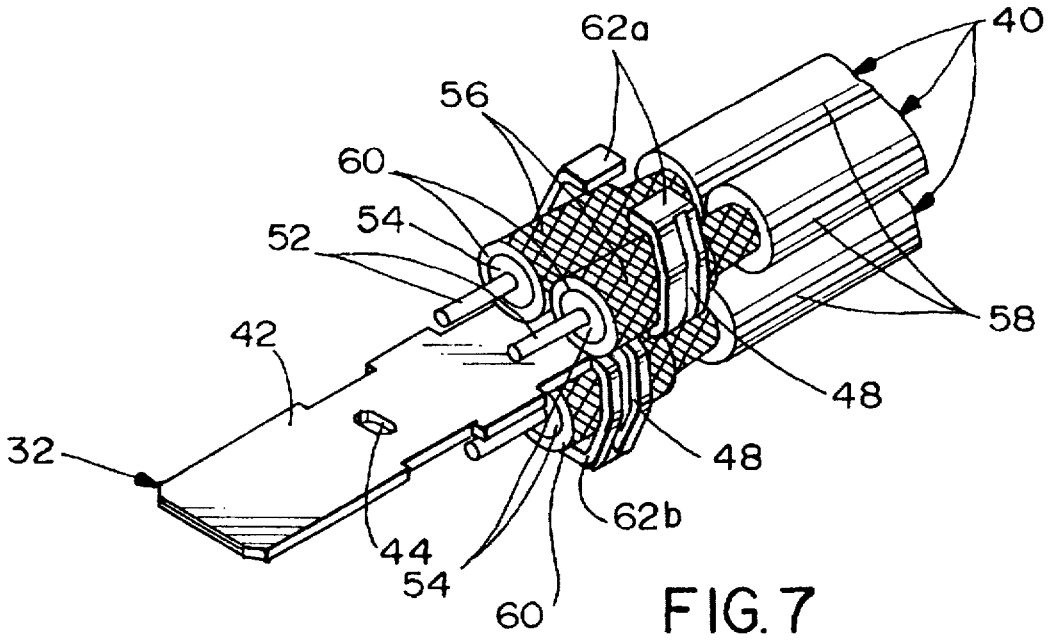
FIG. 7 is a view similar to that of FIG. 6, but showing the coaxial cables properly positioned relative to the gripping arms of the ground plate.

FIG. 7 shows the prepared coaxial cables 40 having been positioned onto ground plate 32 and within the confines of gripping arms 62*a* and 62*b* that are at a partially formed position. It can be seen that the slots 48 in the gripping arms are in registry with the metallic shields 56 of the respective coaxial cables on the outside of insulating sleeves 60.

Figure 8:
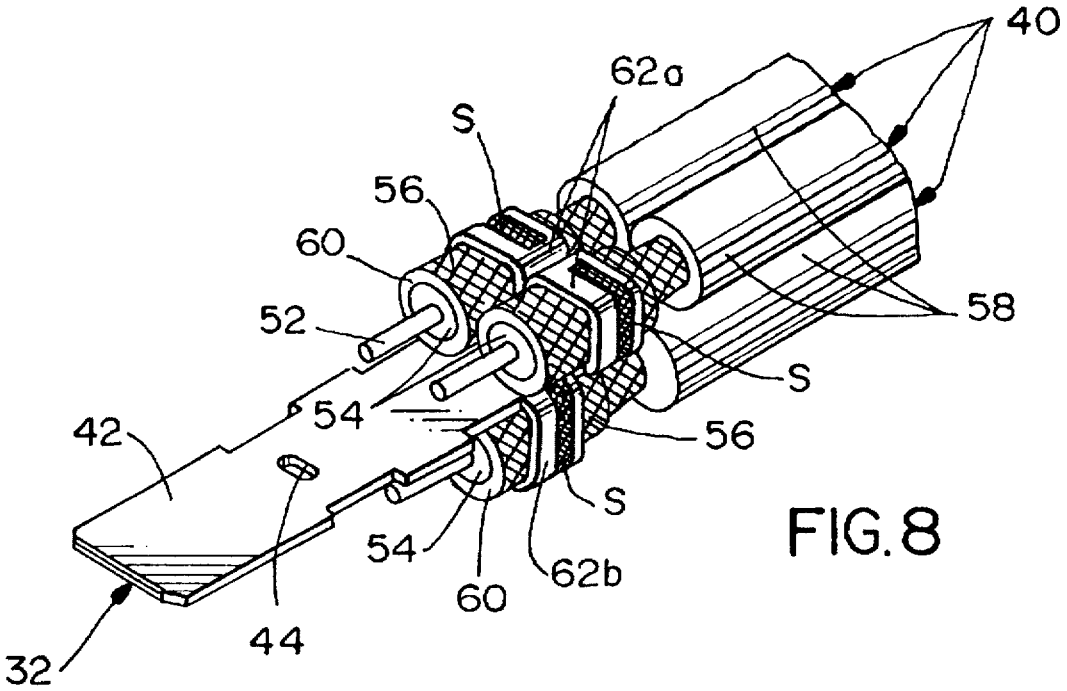
FIG. 8 is a perspective view similar to that of FIG. 7, but with the gripping arms crimped into engagement with the metallic shields of the cable.

The next step in processing the terminal module is to form or crimp gripping arms 62*a* and 62*b* into gripping engagement with the coaxial cables about the exposed metallic shields 56, as shown in FIG. 8. It should be understood that the gripping arms are not crimped onto the metallic shields as is typical in the prior art. An amount of gripping pressure is used to form the gripping arms inwardly, only to grip or retain the coaxial cables. The gripping or crimping pressure should not be excessive so as to damage or deform the underlying insulating sleeves 60 and/or the dielectric material 54 to any extent, which could affect the electrical performance of the cable assembly.

Ground plate 32 then is mechanically and electrically connected to metallic shields 56 of the coaxial cables by soldering the metallic shields to gripping arms 62*a* and 62*b* by soldering through slots 48 in the gripping arms, as at "S" in FIG. 8. As stated above, the slots are formed on the order of 0.040 inch wide to prevent the application of concentrated heat directly to the metallic shield sufficient to cause any heat damage to the underlying insulating sleeve or the dielectric. Regardless of the width of the slots, the slots should be sufficiently narrow to at least prevent whatever soldering iron or tool is used from passing through the slots and into direct engagement with the metallic shield. Such engagement might result in damage to the underlying insulating sleeve or inner dielectric. In essence, the slots restrict the amount of soldering heat which is transmitted inwardly. On the other hand, with the slots extending in a circumferential direction and into blade portion 42 of the ground plate, the slots provide a large area of access to the metallic shields in a circumferential direction. Preferably, the soldering slots extend approximately 180° or more about the center or axis of each respective coaxial cable.

Although the soldering process has been described above as performed in conjunction with a soldering iron or tool, other solder methods are contemplated. For instance, solder paste may be deposited in slots 48, and the solder paste can be reflowed through the subsequent application of heat. In addition, the slots 48 may be removed and the gripping arms may have a heavy tin coating or a solder inlay, and these materials can also be reflowed through the application of heat. In any of these processes, insulating sleeves 60 function to thermally isolate dielectrics 54 and protect the dielectrics from the heat of the soldering process.

Once the subassembly of FIG. 8 is fabricated, including the soldering procedures, this subassembly is assembled to terminal blocks 30*a* and 30*b* and high speed signal transmission terminals 38 to form terminal module 30 as shown in FIG. 9 and described above in relation to FIG. 2. Conductors/cores 52 of the coaxial cables are connected, as by soldering, welding or other means to the inner ends 38*a* of terminals 38, with terminal blocks 30*a* and 30*b* clamping blade portion 42 of ground plate 32 therebetween, as shown in FIG. 2 and described above. The terminal module then is mounted within dielectric housing 12 as shown in FIG. 2. If desired, terminal blocks 30*a* and 30*b* could be mounted to blade portion 42 of ground plate 32 prior to inserting cables 40 between gripping arms 50*a* and 50*b*. In such case, the ground plate 32 shown in FIG. 6 would have the terminal blocks mounted thereon at the beginning of the termination process.

The concepts of the invention have been shown and described herein in conjunction with terminating the metallic shield of the coaxial cable to a terminating member 32 in the form of a ground plate 42. However, it should be understood that the concepts of the invention are equally applicable for terminating the metallic shield 56 to other types of terminating members, such as electrical terminals themselves.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A termination assembly comprising:

a cable having an inner conductor, an inner dielectric at least a portion of surrounding said inner conductor, a metallic shield surrounding at least a portion of said inner dielectric and an outer insulating jacket surrounding at least a portion of said metallic shield, a portion of said outer jacket being removed to expose an exposed portion of said metallic shield;

a thermally insulating member positioned between said metallic shield and said inner dielectric of said cable; and a conductive terminating member at least partially disposed in a dielectric housing of an electrical connector, said terminating member having a gripping portion positioned in registry with said exposed portion of said metallic shield, said gripping portion gripping said metallic shield without deformation of said insulating member such that said metallic shield is disposed between said insulating member and said gripping portion.

2. The termination assembly of claim 1 wherein said insulating member is a high temperature plastic sleeve.

3. The termination assembly of claim 2 wherein said gripping portion of said conductive terminating member includes a slot therethrough in registry with said exposed portion of said metallic shield, said slot being used to solder said exposed portion of said metallic shield to said gripping portion.

4. The termination assembly of claim 1 wherein said conductive terminating member includes a planar ground plate and wherein said gripping portion comprises a gripping arm projecting from said ground plate.

5. The termination assembly of claim 4 wherein said gripping arm has a circumferentially extending slot therethrough for enabling soldering of said exposed portion of said metallic shield to said gripping arm.

6. The termination assembly of claim 5 wherein said slot extends approximately 180° about said cable.

7. A termination assembly comprising:

a pair of cables, each of said cables having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a pair of insulating sleeve members, one of said sleeve members being positionable between said metallic shield and said inner dielectric of one of said pair of cables and the other of said sleeve members being positionable between said metallic shield and said inner dielectric of said other of said pair of cables; and a terminal to which said metallic shields are to be terminated, said terminal being at least partially disposed in a dielectric housing of an electrical connector and having a ground portion including an elongated, generally planar ground plate having a pair of gripping arms projecting from opposite edges of said ground plate near one end thereof, said gripping arms being clamped onto said exposed portions of said metallic shields of said cables thereby clamping said metallic shields between said gripping arms and said sleeve members without deformation of said sleeve members and being bonded to said exposed portions.

8. The termination assembly of claim 7 wherein said insulating sleeve members are high temperature plastic sleeves.

9. The termination assembly of claim 7 wherein each of said gripping arms of said conductive terminating member includes a slot therethrough in registry with said exposed portion of one of said metallic shields, said slot being used in soldering of said exposed portion of one of said metallic shields to one of said gripping arms.

10. The termination assembly of claim 7 including at least one additional cable to be terminated to said ground plate, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including an additional insulating sleeve member disposed between said additional metallic shield and said additional inner dielectric of said additional cable and including a pair of additional gripping arms projecting from opposite edges of said ground plate on a side opposite of said ground plate from which said gripping arms project, at least one of said additional gripping arms gripping said additional exposed portion of said additional metallic shield of said additional cable thereby clamping said additional metallic shield between one of said additional gripping arms and said additional insulating sleeve member without deforming said additional insulating sleeve member and being bonded to said additional exposed portion.

11. The termination assembly of claim 10 wherein said gripping arms are spaced longitudinally on said ground plate from said additional gripping arms.

12. The termination assembly of claim 10 wherein said conductive terminating member is a stamped and formed sheet metal component.

13. The termination assembly of claim 10 wherein each of said insulating sleeve members and each of said additional insulating sleeve members are high temperature plastic sleeve members.

14. The termination assembly of claim 10 wherein each of said gripping arms of said conductive terminating member includes a slot therethrough in registry with said exposed portion of one of said metallic shields, said slot being used to solder said exposed portion of each of said metallic shields to one of said gripping arms and wherein each of said additional gripping arms of said conductive terminating member includes an additional slot therethrough in registry with said additional exposed portion of said additional metallic shield, said additional slot being used to solder said additional exposed portion of said additional metallic shield to one of said additional gripping arms.

15. An electrical connector for termination to a cable that includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages;

an insulating sleeve disposed between said metallic shield and said inner dielectric of said cable; and a ground portion at least partially disposed in said housing relative to said terminals, said ground portion including an elongated, generally planar ground plate having at least one gripping arm projecting from an edge of said ground plate near one end thereof, said gripping arm being adapted to be clamped onto said exposed portions of said metallic shield of said cable thereby clamping said metallic shield between said gripping arm and said insulating sleeve without deformation of said insulating sleeve.

16. The electrical connector of claim 15 wherein said insulating sleeve is a high temperature plastic sleeve.

17. The electrical connector of claim 15 wherein said gripping arm of said ground portion includes a slot therethrough in registry with said exposed portion of said metallic shield, said slot being used to solder said exposed portion of said metallic shield to said gripping arm.

18. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some said terminal receiving passages;

an insulating sleeve disposed between said metallic shield and said inner dielectric of each of said cables; and a ground portion at least partially disposed in said housing relative to said terminals, said ground portion including an elongated, generally planar ground plate having a pair of gripping arms projecting from opposite edges of said ground plate near one end thereof, said gripping arms being adapted to be clamped onto said exposed portions of said metallic shields of said cables thereby clamping said metallic shields between said gripping arms and said sleeves without deformation of said insulating sleeves.

19. The electrical connector of claim 18 wherein said insulating sleeve is a high temperature plastic sleeve.

20. The electrical connector of claim 19 wherein each of said gripping arms of said ground portion includes a slot therethrough in registry with said exposed portion of one of said metallic shields, said slot being used to solder said exposed portion of one of said metallic shields to one of said gripping arms.

21. The electrical connector of claim 18 including at least one additional cable to be terminated to said ground plate, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said electrical connector further including an additional insulating sleeve member disposed between said additional metallic shield and said additional inner dielectric of said additional cable and including a pair of additional gripping arms projecting from opposite edges of said ground plate on a side opposite of said ground plate from which said gripping arms project, each of said additional gripping arms being adapted to be formed onto said additional exposed portion of said additional metallic shield of said additional cable thereby clamping said additional metallic shield between one of said additional gripping arms and one of said additional insulating sleeve member without deformation of said additional insulating sleeve member.

22. The electrical connector of claim 21 wherein said gripping arms are spaced longitudinally on said ground plate from said additional gripping arms.

23. The electrical connector of claim 22 wherein said ground plate is a stamped and formed sheet metal component.

24. The electrical connector of claim 22 wherein each of said insulating sleeve members and said additional insulating sleeve member are high temperature plastic sleeves.

25. The electrical connector of claim 22 wherein each of said gripping arms of said conductive terminating member includes a slot therethrough in registry with said exposed portion of one of said metallic shields, said slot being used to solder said exposed portion of each of said metallic shields to one of said gripping arms and wherein each of said additional gripping arms of said conductive terminating member includes an additional slot therethrough in registry with said additional exposed portion of said additional metallic shield, said additional slot being used to solder said additional exposed portion of said additional metallic shield to one of said additional gripping arms.

* * * * *